US007258777B2

(12) United States Patent
Paul et al.

(10) Patent No.: US 7,258,777 B2
(45) Date of Patent: Aug. 21, 2007

(54) BRIDGES FOR ELECTROOSMOTIC FLOW SYSTEMS

(75) Inventors: Phillip H Paul, Livermore, CA (US); David W Paul, Castro Valley, CA (US)

(73) Assignee: Eksigent Technologies LLC, Dublin, CA (US)

( * ) Notice: Subject to any disclaimer, the term of this patent is extended or adjusted under 35 U.S.C. 154(b) by 280 days.

(21) Appl. No.: 10/896,102

(22) Filed: Jul. 20, 2004

(65) Prior Publication Data

US 2005/0016853 A1 Jan. 27, 2005

Related U.S. Application Data

(60) Provisional application No. 60/488,877, filed on Jul. 21, 2003.

(51) Int. Cl.
*G01N 27/453* (2006.01)
*G05D 7/06* (2006.01)

(52) U.S. Cl. ..... 204/601; 204/600

(58) Field of Classification Search ..... 204/600, 204/601, 605, 450, 451, 454, 455
See application file for complete search history.

(56) References Cited

U.S. PATENT DOCUMENTS 3,923,426 A 12/1975 Theeuwes
5,573,651 A 11/1996 Dasgupta et al.
6,012,902 A 1/2000 Parce
6,214,191 B1 * 4/2001 Wiktorowicz et al. ..... 204/600
6,632,619 B1 * 10/2003 Harrison et al. ..... 435/7.2
6,843,272 B2 * 1/2005 Schoeniger et al. ..... 137/827
7,012,342 B1 * 3/2006 Stamps et al. ..... 307/29

FOREIGN PATENT DOCUMENTS

CN 97212126.9 3/1997

OTHER PUBLICATIONS

Anderson, J. L. et al., "Electroosmosis Through Pores With Nonuniformly Charged Walls," Chemical Engineering Communication, vol. 38, 1985, pp. 93-106.
Desiderio, C. et al., "A New Electrode Chamber For Stable Performance in Capillary Electrophoresis," Electrophoresis, vol. 20, 1999, pp. 525-528.
Gan, W. et al., "Mechanism of Porous Core Electroosmotic Pump Flow Injection System and its Application to Determination of Chromium (VI) in Waste Water," Talanta 51, 2000, pp. 667-675.

(Continued)

*Primary Examiner*—Alex Noguerola
(74) *Attorney, Agent, or Firm*—Anna Heinkel, Esq.; Sheldon Mak Rose & Anderson PC

(57) ABSTRACT

In accordance with the present invention, stable electroosmotic flow systems and methods for designing the same are disclosed. The invention provides electroosmotic flow systems comprising electroosmotic flow elements, including bridge elements, that have matching flux ratios, i.e., when two or more elements of an electroosmotic flow system are in fluidic and electrical communication at a junction, the flux ratio for each of the elements is selected so that the difference in flux ratios system adjacent two elements is less than a target value. The invention also provides methods for designing such systems.

4 Claims, 6 Drawing Sheets

OTHER PUBLICATIONS

Paul, P. H. et al., "Electrokinetic Pump Applications in Micro-Total Analysis Systems, Mechanical Actuation to HPLC," Micro Total Analysis Systems 2000, A van den Berg Editor (Kluwer Academic, Dordrecht, The Netherlands, 2000) pp. 583-590.

Ramsey, J. M. et al., "Microfabricated Interchannel Electrical Contacts for Material Transport Control," Micro Total Analysis Systems 2000, A van den Berg Editor (Kluwer Academic, Dordrecht, The Netherlands, 2000) pp. 213-216.

Park, S., "Electrochemical Detection for Capillary Electrophoresis," Doctoral Dissertation, University of Kansas, 1996, pp. 136-141.

Wallenborg, S.F. et al., "On-chip Separation of Explosive Compounds—Divided Reservoirs to Improve Reproducibility and Minimize Buffer Depletion," Micro Total Analysis Systems 2000, A van den Berg Editor (Kluwer Academic, Dordrecht, The Netherlands, 2000) pp. 355-358.

* cited by examiner

BRIDGES FOR ELECTROOSMOTIC FLOW SYSTEMS

CROSS REFERENCE TO RELATED APPLICATIONS

This application claims the benefit of U.S. Provisional Application No. 60/488,877, filed Jul. 21, 2003, the entire disclosure of which is hereby incorporated by reference in its entirety for all purposes.

BACKGROUND

1. Field of the Invention

This invention relates to electrochemical systems.

2. Background of the Invention

In electrochemical systems, salt- or simple-bridges have been widely employed as a means to isolate electrodes and electrode byproducts from the working fluid, or more generally to isolate one electrochemical environment from another while maintaining ionic communication. A common example is the porous tip of a pH probe. In electroosmotic flow systems, a bridge is used as an ionic conductor that separates the working fluid from the fluid that is in direct contact with the electrodes. The prior art discloses several types of bridges.

For example, Theeuwes discloses the use of membrane bridges between the electrodes and working fluid in an electroosmotic pump. F. Theeuwes, Electroosmotic pump and fluid dispenser including same, U.S. Pat. No. 3,923,426 (1975). The membrane material is a sulfonated polymer having a relatively high zeta potential and very fine pores. The Theeuwes device is essentially a double-reservoir design with the outer (electrode) and inner (working fluid) reservoirs separated by the membrane. The membranes are selected for a very high charge-ratio (defined infra) and selectivity to positive ions (for example, Ag+ and H+ in the Theeuwes case, which thus inhibit current-driven growth of silver dendrites on silver: silver-chloride electrodes).

Seoul discloses a double reservoir bridge design for use in capillary electrophoresis where the outer reservoir contains a platinum wire electrode embedded in a Nafion resin. B. S. Seoul, Electrochemical detection for capillary electrophoresis (Doctoral dissertation, U. Kansas, 1996) pp. 136-141. The objective is to minimize the degradation of analytes by peroxides generated at the anode electrode. Nafion is a sulfonated fluorocarbon polymer that is either solid or very fine pored. It acts as an ionic conductor that is highly selective to positive ions and thus exhibits a very high charge-ratio, implying that current through this material is essentially carried solely by transport of positive ions. This is quite different from current flow in a fluid, where current is carried by transport of both positive and negative ions. Seoul's configuration prevents peroxides generated at the anode electrode from reaching the working fluid. However, the electrode/Nafion current is still carried by H+ ions and, thus, the configuration does nothing to inhibit the pH and ionic strength evolution of the fluid in the inner reservoir.

Desiderio discloses a double reservoir bridge design (similar to that used by Wallenborg infra) for use in capillary electrophoresis where the outer reservoir contains a platinum wire electrode. C. Desiderio, S. Fanali and P. Bocek, "A new electrode chamber for stable performance in capillary electrophoresis," Electrophoresis, 20, 525-528 (1999). The inner and outer reservoirs are separated by a plug of glass wool that serves as the bridge. The object is to minimize the evolution of inner reservoir fluid and thus maintain more constant working fluid properties. The glass wool plug is a porous material having a zeta potential. However, the pore sizes of the conduit and the plug material are sufficiently large that the charge-ratio is negligible. The plug is intended to prevent gross mixing between the outer (electrode) and inner (working fluid) reservoirs.

Ramsey discloses on-chip bridges as a means of making electrical connections in fine microchannels without introducing the gases associated with electrode electrolysis. J. M. Ramsey, S. C. Jacobson, C. T. Culbertson and R. S. Ramsey, "Microfabricated interchannel electrical contacts for material transport control," Micro Total Analysis Systems 2000, A. van den Berg Ed. (Kluwer Academic, Dordrecht, The Netherlands, 2000) pp. 213-216. Ramsey employs an etched glass chip that is bonded to a glass cover using a sodium silicate interlayer. This interlayer acted as a bridge between two adjacent fluid-filled channels on the chip (channel separation of 3 to 10 microns). This type of bridge falls into the selective ion conducting and flow impermeable class. During the bonding process, the sodium silicate mixture (often called water glass) dries out and forms a very fine pored sodium silicate glass (high positive charge-ratio). When wetted this material acts as a solid ionic conductor that, owing to the negative zeta potential of the glass, preferentially transports positive ions. Thus, the current in this material is primarily carried by positive ions, which is quite different from the bulk fluid where the current is carried by a mix of ions.

The electroosmotic flow channels in Ramsey are sufficiently large that the channel charge-ratio is negligibly small whereas Ramsey's bridges have a high positive value of the charge ratio. This leads to a concentration of positive ions (hence increased ionic strength) on the side of the bridge facing the cathode terminal reservoir and a depletion of negative ions (hence decreased ionic strength) on the side of the bridge facing the anode terminal reservoir.

Paul discloses a bridge to make ionic connections to high-pressure junctions in electrokinetically pumped systems. P. H. Paul, D. W. Arnold, D. W. Neyer and K. B. Smith, "Electrokinetic pump applications in micro-total analysis systems, mechanical actuation to HPLC," Micro Total Analysis Systems 2000, A. van den Berg Ed. (Kluwer Academic, Dordrecht, The Netherlands, 2000) pp. 583-590. The bridge allows the electrode to be removed from the working fluid at a junction in a pressurized microchannel. The bridge is formed from a short section of phase-separated and acid-etch glass (e.g., Vycor or Shirasu porous glass). It has nominal 4-nm pores. For the given conditions (nominally 10 mM or less fluid ionic strength) the bridge has very low permeability to pressure- and electroosmotically-driven flow but is subject to a high degree of charge-layer overlap and, thus, ion-selective current transport. The fine-pored glass bridge is highly charge selective and preferentially transports positive ions, owing to the nanometer-scale pores and the high negative zeta potential of the bridge material. Thus, the current in this material is primarily carried by positive ions whereas the current carried in the pump element, based on a predictive model, is carried near-equally by positive and negative ions (Paul shows a silica pump element supplied with nominal pH 7.5 sodium-phosphate buffered fluid). The imbalance in charge fluxes creates a condition where the fluid flowing out of the pump/bridge junction is at a depleted sodium concentration resulting in a lower degree of phosphate ionization. Thus, the working fluid is at a lower ionic strength and a much lower pH than the source reservoir fluid.

Wallenborg describes various types of bridges for mitigating evolution of reservoir fluid in chip-based empty-channel micellar electro-chromatography (see infra for definition of "empty"). S. R. Wallenborg, C. G. Bailey and P. H. Paul, "On-chip separation of explosive compounds—divided reservoirs to improve reproducibility and minimize buffer depletion," Micro Total Analysis Systems 2000, A. Van den Berg Ed. (Kluwer Academic, Dordrect, The Netherlands, 2000) pp. 355-358. Wallenborg discloses that in a device comprising a microchannel connected between two terminal reservoirs, oscillations in both current and flow rate are observed. By replacing each terminal reservoir with two reservoirs in series connected with a bridge, the oscillations are significantly reduced with nano-porous bridge materials (specifically: 4 nm pore Shirasu porous glass, 4 nm pore Vycor porous glass, or a nano-porous polymer monolith). However, the use of the bridge introduces a systematic time-variation in ionic strength and hence variations in conductivity and electroosmotic mobility. A larger pore glass material (specifically 70 nm pore Shirasu porous glass) reduces the variation in ionic strength. The small-pored media introduces ion-selective current transport through the bridge and hence the variation in fluid conductivity. This effect is reduced but not eliminated using the larger-pored media that also allows electroosmotic flow. In very fine pored bridge materials the fractional selectivity to current-driven charge transport by ions of one sign is about unity, whereas in the bulk working fluid, this same selectivity is generally about 10% or less owing to minor differences in ion mobilities.

Gan describes the use of a thin cellulose-acetate membrane as a bridge-like structure to isolate fluid in direct contact with the electrodes from fluid flowing in an electroosmotic pump driven by current supplied from the same electrodes. W. Gan, L. Yang, Y. He, R. Zeng, M. L. Cervera and M. de la Guardia, "Mechanism of porous core electroosmotic pump flow injection system and its application to determination of chromium (VI) in waste water," Talanta 51 pp. 667-675 (2000) which references Y. Z. He and W. E. Gan, Chinese Patent ZL 97212126.9 (1998). A membrane of this type and structure acts to reduce gross mechanical mixing of the fluids. This type of bridge provides the same effect as the glass wool plug used by Desiderio.

Parce describes the use of bridges (termed by Parce a 'flow restrictor' or 'flow restrictive element') incorporated into microchannel systems applied to placement of electrodes within the fine channels of the system to avoid electrolysis therein. J. W. Parce, Micropump, U.S. Pat. No. 6,012,902 (2000), col. 8, ll. 5-10. See also J. W. Parce, Micropump, WO99/16162 (1999). Parce describes the flow restrictive element as ' . . . provided to allow passage of current between the electrodes, while substantially preventing flow . . . ' Id., col. 8, ll. 36-39. Parce further recites that '[i]n at least a first aspect, the flow restrictive element includes a fluid barrier that prevents flow of fluid, but permits transmission of electrons or ions, e.g., a salt bridge.' Id., col. 8, ll. 44-47. Parce discloses the following types of bridges: agarose or polyacrylamide gel plugs, Id., col. 8, l. 47; a series of parallel channels each having a much smaller cross sectional area than the remaining channel structure, to reduce the electroosmotic flow through the side channel (bridge) (for example, the much smaller cross sectional area channels have at least one cross sectional dimension in the range from 0.001 to 0.05 microns when the other channels in the system have a size range of about 20 to 100 microns) Id., col. 8, ll. 49-65; and a side channel (bridge) which optionally includes a plurality of side parallel channels, and also substantially lacks surface charge to reduce or eliminate any electroosmotic flow. Id., col. 8, l.-66 to col. 9, l.-2.

Parce also describes a configuration that uses two pumping channels (having substantially different charge magnitude and/or sign from each other) that are connected in electrical series. Id., col. 9, l.3 to col. 10, l.12. In this configuration, the difference in zeta potential produces a difference in flow rates that results in production of a pressure at the common junction that is used to induce a pressure-driven flow through a third channel connected to this common junction. The phenomena of pressure generation due to variation of zeta potential along a channel is a well-known process [see for example, J. L. Anderson and W. K. Idol, "Electroosmosis through pores with nonuniformly charged walls," Chem. Eng. Commun., 38 pp. 93-106 (1985)].

Because the pumping channels recited by Parce are very large, the channel charge-ratio is negligibly small. Further the finer side channels (bridge) are described as substantially lacking surface charge, this implies a negligibly small value for the charge ratio. The system described by Parce thus operates in the limit of negligible charge-layer effects hence negligible charge-layer-driven net solute transport.

Dasgupta describes the use of a 'membrane grounding joint' made of Nafion ion exchange tubing at the end of an empty silica capillary. P. K. Dasgupta and S. Liu, Apparatus and method for flow injection analysis, U.S. Pat. No. 5,573,651 (1996). The grounding joint acts as a bridge to make an electrical connection to the empty capillary that in turn serves as an electroosmotic-flow-pump (EOF pump). Such a bridge is highly selective to positive ion migration (i.e., substantial positive charge ratio) and therefore not matched with the empty capillary electroosmotic flow element (i.e., negligibly small charge-ratio). As direct evidence of the effect of this mismatch, Dasgupta observes that if the outlet hydrostatic resistance to an EOF pump is increased, the resulting drop in flow rate is accompanied by a decrease in current at the same applied voltage (in fact, this phenomenon is not observed for any uniform ionic strength fluid). The ionic flux mismatch incurred through the use of a Nafion bridge, produces a decrease in ionic strength at the bridge joint. Under normal operation this fluid is carried downstream. With an increase in outlet hydrostatic resistance and hence an increase in backpressure, some fluid from this joint is back flushed into the pumping element. The introduction of the lower concentration, hence lower conductivity, fluid yields the observed reduced current. Without an ionic mismatch at the bridge, the current would be expected to stay substantially constant as the hydrostatic resistance is varied.

To summarize, prior art bridges in electroosmotic flow systems generally fall into four classes: (1) porous media or a membrane with large pores that allows pressure- and electroosmotically-driven flow but inhibits gross mechanical mixing; (2) non-specific ion conducting and flow impermeable media (e.g., a classic salt bridge); (3) porous media with relatively fine pores that greatly restrict pressure- or electroosmotically-driven flow (e.g., pores of order 5 nm diameter or less); and (4) specific ion conducting and flow impermeable media. In the first and second classes and in the third class for materials without a zeta potential, the charge-ratio is negligibly small and, therefore, the material adds little selective current-driven transport of particular ions. In the third class for media with a zeta potential and in the fourth class, the charge-ratio is substantial and the bridge materials are strongly ion-selective and, therefore, the electrode has been removed from direct contact with the working fluid but the action of the bridge may concentrate select ions, thus evolving the working fluid and possibly creating a condition leading to unsteady state operation.

Most of the prior art in electroosmotically-driven flow systems is in the area of interconnected empty microchannel elements, where the conduit diameter is large enough that flux imbalances are essentially negligible (i.e., negligibly small values of the charge-ratio). Thus, the prior art does not teach stable electroosmotic flow systems or bridges for such systems for the substantial charge ratio regime. In fact, the prior art is predominantly concerned with bridge designs for systems where the charge-ratios are negligible for all elements in the system. Bridge designs for substantial charge-ratio cases (the third and fourth classes supra) actually compound the problem of differential ion flux and hence concentration evolution. Therefore, there is a need for stable electroosmotic flow systems that contain elements that are subject to some degree of charge-layer overlap leading to unequal flux ratios. The present invention addresses these and other deficiencies of the prior art by providing bridge devices that improve the stability of an electroosmotic system.

SUMMARY OF THE INVENTION

The invention provides a bridge device that comprises at least two bridge elements connected electrically in parallel. The bridge elements are selected so that one member has a charge ratio that is less than that of an active electroosmotic flow ("EOF") element to which it is coupled, and another member has a charge ratio that is greater than that of an active electroosmotic flow element to which it is coupled. In one aspect of the invention, the bridge device is optimized to minimize differences between the flux ratios of the bridge elements and the active EOF element to which they are connected and thereby improve the stability of the system. In another aspect, the invention provides for junctions between the porous materials of the active element(s), the bridge elements, and the working fluid. In yet another aspect, the invention provides bridge elements having physical geometry and material permeability selected to optimize flow through the active electroosmotic flow element(s).

DETAILED DESCRIPTION OF THE PREFERRED EMBODIMENTS

Figure 1:
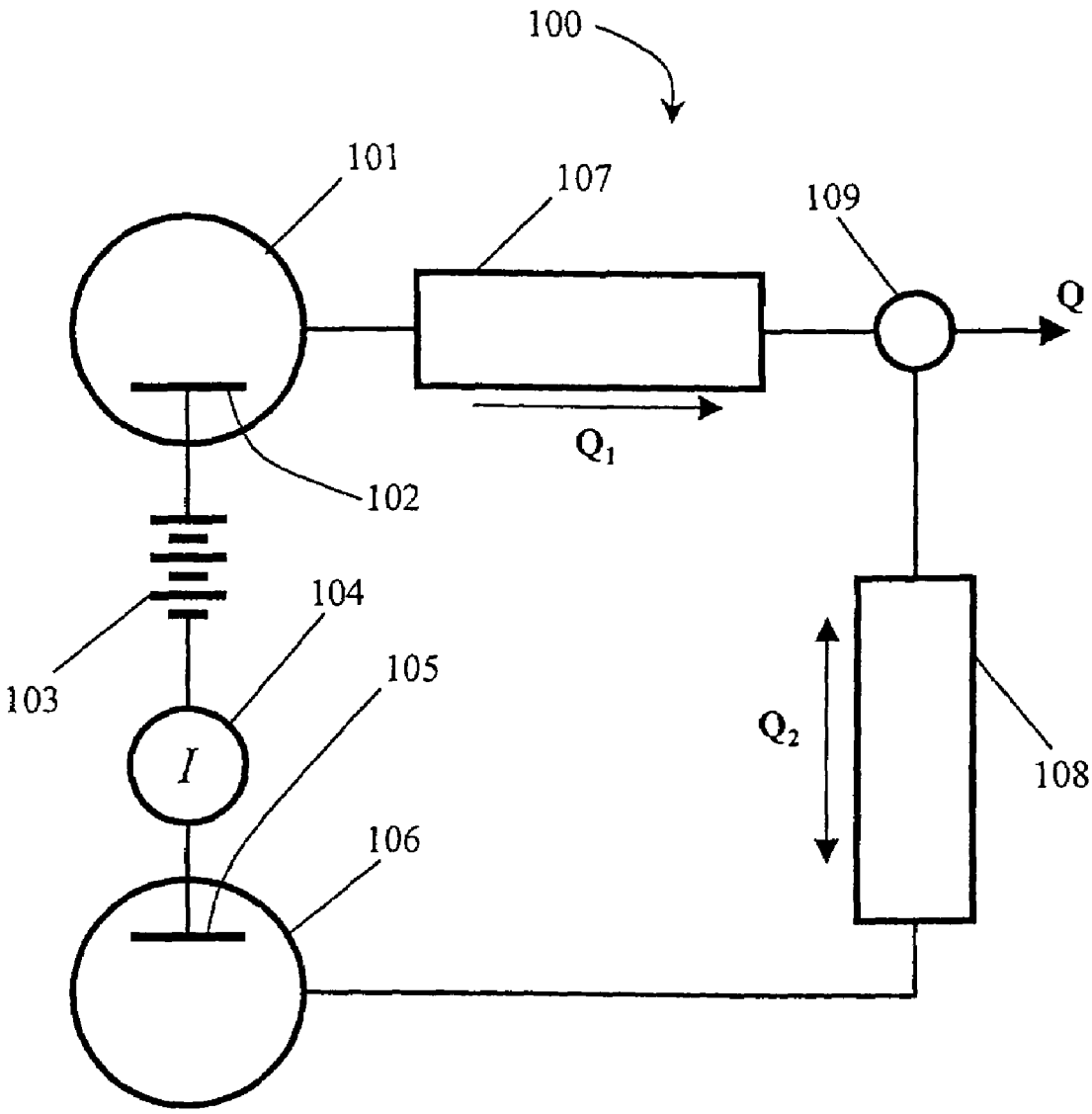
FIG. 1 is a schematic of a two-element electroosmotic flow ("EOF") system.

In describing and claiming the invention below, the following abbreviations and definitions (in addition to those already given) are used.

A area $m^2$

L axial length m

F Faraday constant $9.65\times10^4$ Coulomb/mole

Fn formation factor dimensionless

ρ electrical resistance Ohm

σ electrical conductivity mho/m $R_f$ liquid flux ratio (see Eq. 5) dimensionless e elemental charge $1.602\times10^{-19}$ Coulomb ϵ liquid permittivity, product of liquid relative permittivity and $\epsilon_o$ Farad/m $\epsilon_o$ permittivity of free space $8.854\times10^{-12}$ Farad/m $k_b$ Boltzman constant $1.38\times10^{-23}$ Joule/Kelvin T absolute temperature Kelvin μ liquid dynamic viscosity Pascal-seconds ξ zeta potential Volts E electric field Volts/m J current flux Amperes/$m^2$ $J_D$ solute displacement flux Amperes/$m^2$ R flux ratio dimensionless λ Debye length m Λ dynamic pore scale m n ion mobility $m^2$/Volt-second Q flow rate liter/second C concentration number/$m^3$ I current Amperes ν electroosmotic mobility $m^2$/Volt-second cr charge ratio dimensionless g geometry factor (=A/$LF_n$) m k flow conductance (=$M\Lambda^2$ g/μ) liters/second-Pascal M pore geometry number dimensionless P pressure Pascals V voltage Volts K load factor dimensionless TRIS tris-hydroxymethyl-aminomethane MES 2-morpholinoethanesulfonic acid BIS-TRIS bis-2-hydroxyethyl-imino-tris-hydroxymethyl-aminomethane HEPES 4-2-hydroxyethyl-piperazine-1-ethanesulfonic acid HCl Hydrochloric acid TMBA tri-methoxybenzoic acid Flux Ratio Flux ratio is the ionized species solute displacement flux per unit current flux through an electroosmotic flow ("EOF") element. The concept is fully explained and illustrated in co-owned U.S. patent application Ser. No. 10/137,215 filed May 1, 2002, the entire disclosure of which is herein incorporated by reference for all purposes.

The flux of the $i^{th}$ ionic species may be written as:

$$j_i=(z_i n_i-\gamma(y_o-y))C_i E, \quad \text{(Eq. 1)}$$

where $z_i$, $n_i$, and $C_i$ are the signed valence, the mobility and the local concentration of the $i^{th}$ species, respectively; $\gamma=\epsilon k_b T/e\mu$; and $y_o=e\xi/k_b T$. It will be appreciated that several of the quantities in the species flux equation vary as a function of position within the pore. A representative volume element is defined as a volume element that is sufficiently small that axial (i.e., E-field directed) gradients in quantities may be well approximated by first-order expansion terms, but sufficiently large to contain a statistically significant sample of the whole pore size distribution. Taking a formal volume average (denoted by the operator ⟨. . . ⟩) over the representative volume elements allows the total axial current and concentration displacement fluxes to be written $$J=e\Sigma z_i\langle j_i\rangle \text{ and} \quad \text{(Eq. 2)}$$

$$J_D=e\Sigma\langle j_i\rangle-e\langle U\rangle\Sigma C_i^o, \quad \text{Eq. 3)}$$

respectively, where the summations are over all ionic species and the $C_i^o$ are the concentrations of the species in bulk fluid. The 'flux ratio' is then defined by:

$$R=J_D/J.$$

For a binary, univalent electrolyte this may be expanded to read $$R \cong \frac{R_f + \frac{4\lambda}{\Lambda}[R_f(c-1) - s - \varphi y_o(2c - 1 - 2sc/y_o)]}{1 + \frac{4\lambda}{\Lambda}[(c-1) - R_f s - \varphi y_o(2s^2/y_o - 2s)]}, \quad \text{(Eq. 4)}$$

where s and c are the hyperbolic sinh and cosh functions of argument $y_o/2$. Here $\lambda$ is the Debye length in the fluid and $\Lambda$ is the dynamic pore scale and $$R_f=(n_+-n_-)/(n_++n_-) \quad \text{(Eq. 5)}$$

$$\phi=\gamma/(n_++n_-), \quad \text{(Eq. 6)}$$

where $n_+$ and $n_-$ are the mobilities of the positively and negatively charged ions.

For $\lambda<<\Lambda$ or for values of the zeta potential, hence $y_o$, tending to zero, the value of R goes to the value of $R_f$. However, for a finite value of $y_o$ and the value of $\Lambda$ approaching the value of $\lambda$, R tends to limiting values of ± 1 taking the sign opposite that of the zeta potential.

Extension of the analyses to non-symmetric or polyvalent or complex electrolytes is a straightforward exercise for anyone familiar with the science of electrochemistry.

An example electroosmotic flow system is shown schematically in FIG. 1. As can be seen, the system 100 shown in FIG. 1 comprises a first electrode reservoir 101 that contains a working fluid that is in electrical contact with a first electrode 102, and a second electrode reservoir 106 that contains the working fluid that is in electrical contact with a second electrode 105. The system 100 further comprises a power supply 103 electrically connected to electrodes 102 and 105 so that current can flow between the electrodes. An ammeter 104 is provided to measure the current. Electrode reservoir 101 is in electrical and fluidic communication (or "connected" for short) to the first end of a first electroosmotic flow element 107. The second end of the first electroosmotic flow element 107 is connected to the inlet of junction 109, which also has a first outlet and a second outlet. The first outlet of junction 109 is connected to the first end of a second electroosmotic flow element 108. The second outlet of junction 109 may be connected to a reservoir or to a liquid collection device, which can be used to measure the flow rate of the liquid leaving the second outlet. The second end of the second EOF element 108, which may be a bridge, is connected to the second electrode reservoir 106. Denoting the first and second electroosmotic flow elements by the subscripts '1' and '2', respectively, the flow rate of the working fluid through the first EOF element is $Q_1$, that through the second EOF element is $Q_2$ and that through the second outlet is Q.

The electrode reservoirs are sufficiently large that the ionic composition of the fluid within the reservoirs may be assumed to be reasonably constant over the course of a test experiment. The reservoirs contain a simple salt, at some concentration C, dissolved in a liquid. The power supply 103 may be a source of direct current. An ionic current carried through the fluid in the first and second elements will yield a displacement flux and may yield an electroosmotic flow. The direction of the applied potential and the order of the elements are such that the flow through the first element is towards the second element, and the flow through the second element is less than that through the first element. Thus there will be a net flow, Q out of junction 109 as shown in FIG. 1. The ionic concentration, C', in the liquid flowing out of the junction for three cases is:

1. For the case where the flow through the second element is negligible (i.e., $Q_1>>Q_2$) or for the case where the flow through the second element is away from the first element, $$C'=C+(R_2-R_1)I/eQ_1, \quad \text{(Eq 7)}$$

where $Q_1$ is the flow rate through the first element.

2. For the case where the flow through the second element is towards the first element, $$C'=C+(R_2-R_1)I/eQ, \quad \text{(Eq. 8)}$$

where Q is the flow rate out of the common junction (i.e., $Q_1+Q_2$).

3. For the case where the flow through the first element is conserved through the second element (i.e., $Q_1=Q_2$ and the flow through the second element is away from the first element) and hence there is no flow out of the common junction, Eq. 7 applies, and C' is the concentration in the fluid at the junction between the elements.

The difference in the flux ratios (i.e., $R_2-R_1$) can be determined from measurements of the total current, I, the appropriate flow rate, and given measures of C and C' (that might be derived by measuring the conductivity of the liquids). Obviously if the value of C' is about the value of C then the flux ratios are near-matched. The absolute flux ratio of one element may also be determined if the value of the flux ratio of the other element is known a priori.

As noted, the flux ratio reduces to $R_f$ for an element having a vanishingly small zeta potential or for an element having a dynamic pore scale much larger than the Debye length. For a given ionic composition of a fluid the value of $R_f$ is known. Thus, the flux-ratio of the first element can be determined by using a second element where the pore size and/or zeta potential are selected so that the flux ratio of the second element is $R_f$. For example: the second element may be a capillary or a conduit filled with a porous material where the capillary and/or porous materials are selected for relatively large dynamic pore scale (e.g., more than one micron) and vanishingly small zeta potential (e.g., Teflon, PEEK or polypropylene). The flow rate through the second element follows Darcy's law and, thus, may be calculated from a measurement of the pressure drop across the second element. The fluid in the junction subsequently flows through and saturates the second element. The ratio of current to the voltage drop across the second element is directly proportional to the conductivity of the fluid. The conductivity of the fluid at starting conditions (where the system is saturated end-to-end with reservoir fluid) provides a measure of C whereas the conductivity observed with current applied to the system provides a measure of C'. If the fluid contains a buffering solution, to determine fluid composition, in addition to conductivity, the pH of the fluid may also need to be measured.

As an illustration, consider the case of a binary univalent electrolyte. If the flow rate through the second element is negligible, the relative change in concentration may be approximated by:

$$\frac{C'}{C} - 1 \approx (R_2 - R_1)\frac{n_+ + n_-}{v_1}, \quad \text{(Eq. 9)}$$

where $v_1 = e\xi/\mu$ of the first element (often termed the electroosmotic mobility). In many cases the electroosmotic mobility is less than the typical ionic mobility, and, thus, the latter ratio (in the equation immediately above) is often greater than unity and may reach values exceeding 10. For example, taking the ratio of mobilities (in the equation immediately above) to have a value of 2, and matching the flux ratios to within 2% would yield a fractional change in composition of less than 4%. The ratio of mobilities provides an estimate of the slope sensitivity to flux ratio mismatches. The degree of flux ratio matching required in a given application is then directly related to the acceptable tolerance to composition variation in that application. The foregoing provides a basis for designing electroosmotic flow systems in accordance with the invention.

The flux ratio for any individual EOF element can be obtained by appropriate calculation and observation as described above. However, for purposes of the present invention, the magnitude of the difference between the flux ratios of two EOF elements connected to the same junction in an operating EOF system is preferably obtained by measuring particular variables, followed by appropriate calculation, as explained below with reference to FIG. 2. The possible range for the flux ratio of an individual EOF element is from −1 to +1. The calculation set out below gives the magnitude of the difference (i.e., the absolute difference) between the flux ratios, i.e., with a theoretically possible range of 0 to 2.

Figure 2:
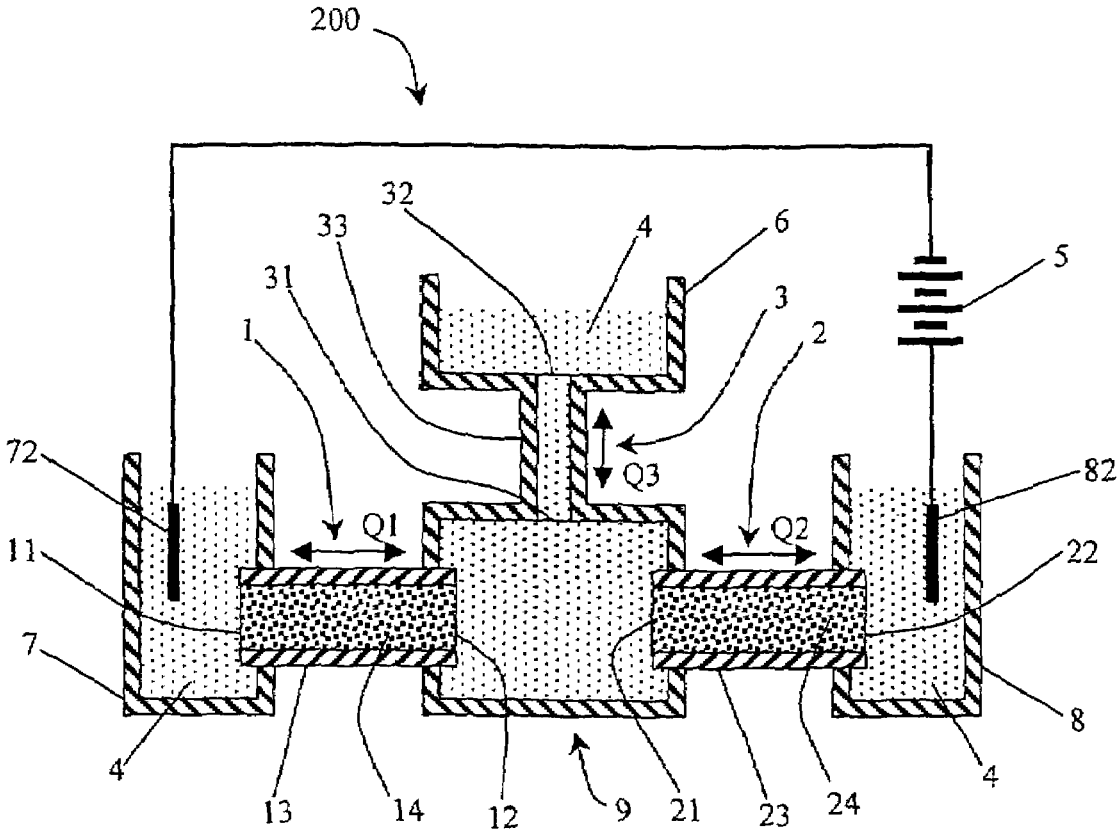
FIG. 2 is a diagrammatic cross-section of an EOF system.

FIG. 2 is a diagrammatic cross-section of an EOF system 200 comprising first and second EOF elements 1 and 2, passive flow element 3, reservoir 6, and electrode reservoirs 7 and 8, which contain electrodes 72 and 82 respectively connected to DC power supply 5. The system is filled with an ionic liquid 4 through which ionic current flows. EOF element 1 comprises a wall 13 enclosing a porous medium 14, and has first and second terminal portions 11 and 12. EOF element 2 comprises a wall 23 enclosing a porous medium 24, and has first and second terminal portions 21 and 22. Element 3 has a wall 33 defining an open conduit, and has terminal portions 31 and 32. The terminal portions 12, 21, and 31 open into a junction 9 containing the liquid 4 at a concentration C9. The current through the junction 9 is Ij and is positive when it flows from EOF element 1 towards EOF element 2. Terminal portion 11 opens into electrode reservoir 7 containing the liquid 4 at a concentration C7. Terminal portion 22 opens into electrode reservoir 8 containing liquid 4 at a concentration C8. Terminal portion 32 opens into a reservoir 6 containing liquid 4 at a concentration C6. Liquid 4 flows through element 1 at a rate Q1, through element 2 at a rate Q2, and through element 3 at a rate Q3.

The magnitude of the difference between the flux ratios of the two EOF elements (R1−R2) can be calculated from the equation:

$$R1-R2 = \Sigma QkCk*F/Ij, \quad \text{(Eq. 10)}$$

where ΣQkCk is the sum of the quantity Qk*Ck for each of k EOF elements flowing into the junction, where Qk is the rate of flow in microliters per minute and Ck is the concentration in millimole/liter at the terminal portion of the EOF element remote from the junction, F is the Faraday constant ($9.65\times10^4$ Coulomb/mole), and Ij is the current through the junction in microamps.

The sign of the quantity will depend on the sign of the current. However, for the purposes of the present invention, the magnitude of the difference between the flux ratios does not depend on the sign of the quantity resulting from the above calculation.

The Table below shows how the magnitude of the difference in flux ratios between the two EOF elements is calculated for the different possible flow directions ("in" being towards the junction 9, and "out" being away from the junction 9) in the EOF system of FIG. 2 when the ionic liquid is a simple salt dissolved in a solvent. The calculation when Q3 is zero is applicable also to a system in which there is no flow element 3. The calculation when Q1 is zero is applicable to a system in which EOF element 1 is a bridge.

| Q1 | Q2 | Q3 | R1−R2 |
|---|---|---|---|
| out | out | in | {Q3*(C6 − C9)}*F/Ij |
| out | in | in | {Q2*(C8 − C9) + Q3*(C6 − C9)}*F/Ij |
| in | out | out | {Q1*(C7 − C9)}*F/Ij |
| in | out | zero | {Q1*(C7 − C9)}*F/Ij |
| in | zero | out | {Q1*(C7 − C9)}*F/Ij |
| zero | in | out | {Q2*(C8 − C9)}*F/Ij |

By way of example, if, in the circumstances shown in the last entry in the Table above, Q2 is 2 microliters per minute, C8 is 5 millimole/liter, C9 is 4.5 millimole/liter, and Ij is −4 microamps, the value of (R1−R2) is about −0.40, and the "magnitude of the difference between the flux ratios" is 0.40.

When four or more EOF elements are connected to a single junction, the corresponding equations will contain separate terms for the magnitude of the differences in flux ratios between different pairs of EOF elements. By measuring the values of the different variables with the currents through the system at two or more sets of values, two or more simultaneous equations can be obtained and can be solved to calculate the magnitude of the differences in flux ratios between the different pairs of EOF elements. Those skilled in the art will have no difficulty, having regard to their own knowledge and the disclosure of this specification, in carrying out such calculations.

When the ionic liquid is a polyvalent or complex electrolyte, the calculations are somewhat different, but again those skilled in the art will have no difficulty, having regard to their own knowledge of the disclosure of this specification, in carrying out such calculations.

Charge Ratio

The charge ratio on an EOF element is the weighted-volume equivalent concentration of surface charge divided by the ionic strength concentration of the bulk liquid. The charge ratio is a measure of the extent to which the EOF element contains surface layers having a net charge. In the bulk liquid of the EOF element, there are equal quantities of positive and negative ions, and the fraction of the current carried by any particular ion depends on its mobility. In a charged surface layer, however, there is an excess of ions of one sign or the other, and the fraction of the current carried by any particular ion depends both on its mobility and the excess or deficit of that ion. This results, when EOF elements having different charge ratios are connected in series, in a mismatch in the ion fluxes at the junction between the elements. As a result, at the junction, a concentration/ diffusion layer forms at the interface between the EOF elements and the junction liquid; and in the junction liquid, the concentration of one type of ion continuously increases, and the concentration of the other type of ion continuously decreases. This often causes instability, for example in the current and/or the flow rate. The mismatch is particularly serious (and the solutions provided by the present invention particularly valuable) in microfluidic systems having small reservoir and junction volumes, especially in chemical analysis systems, and in systems operating under pressure differences greater than 0.7 kg/cm$^2$ (10 psi), for example greater than 7 kg/cm$^2$ (100 psi), or greater than 70 kg/cm$^2$ (1000 psi), e.g., 7 to 700 kg/cm$^2$ (100 to 10000 psi) or 35 to 350 kg/cm$^2$ (500 to 5000 psi).

For an EOF element filled with a binary univalent electrolyte pair, the charge ratio (cr) can be calculated from the equation:

$$cr=(-8\lambda/\Lambda)\sinh(e\xi/2k_bT), \quad \text{(Eq. 11)}$$

where $\lambda$ is the Debye length (in meters) in the bulk liquid, $\Lambda$ is the dynamic pore scale (in meters) and $\xi$ is the zeta potential (in volts). $\Lambda$ is used to characterize the diameter of the pores in a porous medium. For a right regular conduit that is not filled with porous material, $\Lambda$ is equivalent to the hydraulic diameter. Those skilled in the art know how to calculate the charge ratio when more complex electrolytes are used. The sign of the charge ratio may be positive or negative. If the values of the variables in this equation are not known, they can be determined by the following procedure. The EOF element is filled with a liquid having a known bulk conductivity $\sigma$ (in mho/m). The electrical resistance $\rho$ (in Ohm) of the liquid-filled element is determined. A geometric factor (g) is calculated from the equation:

$$g=1/\sigma p. \quad \text{(Eq. 12)}$$

The electroosmotic flow rate, Qeo, through the element is measured in response to an electrical potential $\Delta V$ applied across the element. Qeo is given by the equation:

$$Qeo=\epsilon\xi\Delta Vg/\mu, \quad \text{(Eq. 13)}$$

where $\epsilon$ is the permittivity of the liquid and $\mu$ is the dynamic viscosity of the liquid. Qeo is also given by the equation:

$$Qeo=\epsilon\xi I/\mu\sigma, \quad \text{(Eq. 14)}$$

where I is the current flowing through the element due to the applied potential $\Delta V$ across the element. Using this equation and the previously determined values for Qeo, $\epsilon$, I, $\mu$ and $\sigma$, the zeta potential, $\xi$, is calculated. A pressure difference $\Delta P$ is then applied across the element in place of the applied potential, and the pressure-driven flow rate, Qp, through the element is measured. Qp is given by the equation:

$$Qp=\Lambda^2\Delta Pg/32\mu. \quad \text{(Eq. 15)}$$

Using this equation and the previously determined values for Qp, $\Delta P$, g, and $\mu$, the dynamic pore scale, $\Lambda$, is calculated.

Finally, the equation $$cr=(-8\lambda/\Lambda)sinh(e\xi/2k_bT) \quad \text{(Eq. 16)}$$

is applied using the above-determined parameters to calculate the charge ratio.

Alternate Bridge Device

In selecting a bridge for a given application: The first objective is to match the flux ratio of the bridge device to the flux ratio of the active EOF element (here the 'active' element may be an electrokinetic ("EK") pump or an EK flow controller (such as that described in co-owned patent publication No. U.S. 2002/0189947 A1) or any other type of EOF element that is supplied with a current and carries a process fluid), and by this matching satisfy the requirements for stability on the whole-system-level. A second objective is to tailor the interfaces between the porous materials present in bridge elements and or active EOF elements and the open fluid, at junctions, to minimize the effects of interfacial diffusion layers, and by this promote stability and more optimal operation at the microscopic level. A third objective is to select the bridge physical geometry and material permeability to optimize the flow through the active element. The following presents a new type of bridge device and methods of using this device. This new device meets the general objectives for selecting a bridge and has the added benefits of: general applicability to a wide range of fluids and active elements, flexibility, relatively low bridge permeability, and the added capability to employ substantially different fluid compositions in the bridge reservoirs.

Traditional bridges comprise a single element connected in electrical series with an active EOF element. The flux ratio of the active element is set by the composition of the working fluid, including any additives present, along with the characteristics of the active element (specifically the dynamic pore scale and the zeta potential). Matching the bridge flux ratio is then subject to a particular relationship between bridge dynamic pore scale and bridge zeta potential, that is: given the active element flux ratio and the bridge pore scale (or zeta potential) then the required bridge zeta potential (or pore scale) is determined. This condition may be difficult to satisfy when combined with further design requirements for the bridge material, in particular the requirement that the material has low flow permeability.

Figure 3:
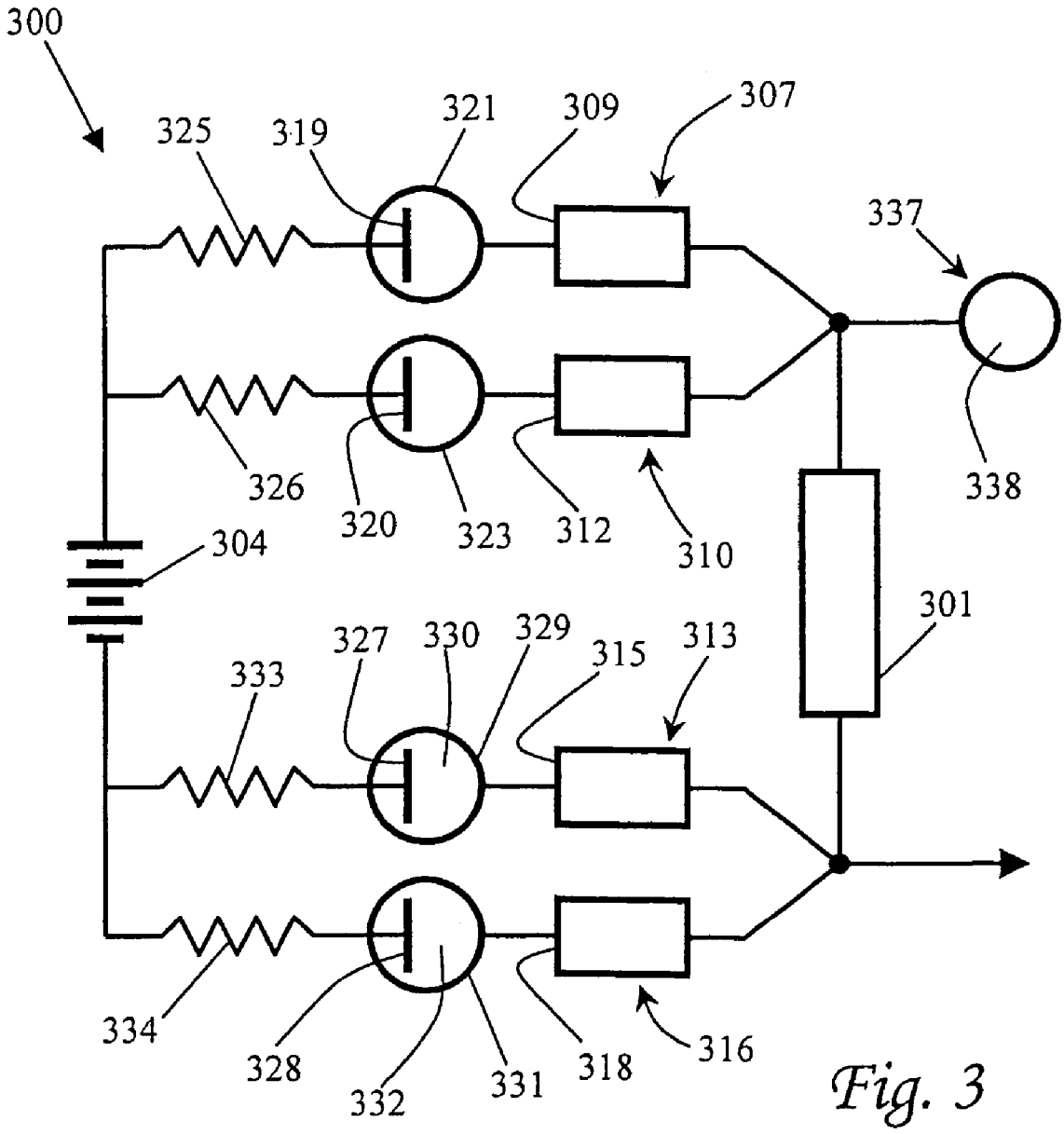
FIG. 3 is a schematic of an EOF system having two pairs of bridge elements.

The new device replaces the traditional bridge with two or more bridge elements connected electrically in parallel. FIG. 3 illustrates an EOF system 300 having two pairs (307, 310, and 313, 316) of bridge elements. Consider first the simplest case in which there are two bridge elements 307 and 310 connected to an active EOF element 301. Taking the charge ratio of active element 301 to be cr1, the charge ratios of bridge element 307 to be cr2 and bridge element 310 to be cr3, the ratios cr1, cr2, and cr3 are selected to lie in the ranges cr2<cr1 and cr1<cr3. As a result the flux ratio of active EOF element 301 will lie between the flux ratios of the bridge element 307 and bridge element 310. The current $I_1$ carried by the active EOF element 301 will be the sum of the currents $I_2$ and $I_3$ carried by bridge elements 307 and 310. The condition for matching may then be written:

$$I_2R_2+I_3R_3=I_1R_1, \quad \text{(Eq. 17)}$$

recognizing that $$I_1=I_2+I_3, \quad \text{(Eq. 18)}$$

where $I_i$ is the current and $R_i$ is the flux ratio through the $i^{th}$ element, the first element corresponds to active EOF element 301, the second element corresponds to bridge element 307, and the third element corresponds to bridge element 310. The flux ratios $R_i$ are given properties of the respective materials, the liquid, and any additives to the liquid. The matching condition is satisfied by setting the fractional current flowing through the second element 307, $$I_2/I_1=(R_1-R_3)/(R_2-R_3), \quad \text{(Eq. 19)}$$

and thus the fractional current through the third element 310, $$I_3/I_1=(R_2-R_1)/(R_2-R_3), \quad \text{(Eq. 20)}$$

or equivalently the ratio of currents flowing through the third and second elements 310 and 307, $$I_3/I_2=(R_2-R_1)/(R_1-R_3). \quad \text{(Eq. 21)}$$

While optimal stability is obtained by setting the relative currents according to this relationship, enhanced stability as compared to prior art systems still may be achieved when the quantities on each side of the equation differ by less than about 30%, or by less than about 10% or by less than about 1%.

In the schematic diagram of FIG. 3, active element 301 (first element) is connected to attendant input 307, 310 (second and third elements) and output 313, 316 (fourth and fifth elements) bridge sets. Obviously, depending on the application input and/or output bridge sets may be employed. In FIG. 3, bridge elements 313 and 316 serve the same respective roles as bridge elements 307 and 310 described above. Considerations regarding the characteristics of and connections to bridge elements 307 and 310 apply equally to bridge elements 313 and 316. In FIG. 3 the total potential difference supplied to the system 300 by power supply 304 is $\Delta V_S=V-V_o$. The electrical connections are made via electrodes 319, 320, 327, and 328, respectively, in contact with the fluid at the terminal ends 309, 312, 315, and 318 of bridge elements 307, 310, 313, and 316.

The relative currents carried through elements 307 and 310 are set according to Eq. 21. The right-hand side of this equation is a function of the materials and fluid. For notational simplicity, in the following the right hand side of this equation is set equal to $\alpha$. The current through an element may be written:

$$I_i=\sigma_i g_i \Delta V_i, \quad \text{(Eq. 22)}$$

where $\sigma_i$ is the effective electrical conductivity of the fluid-saturated element, $g_i$ is the geometry factor and $\Delta V_i$ the voltage drop across the $i^{th}$ element.

In applications where like materials bridge elements are employed on either side of an active element, the ratio of currents will be the same, that is $I_5/I_4=I_3/I_2$. When unlike material bridge elements are employed on either side of an active element the current ratio for elements 4 and 5 (313 and 316 in FIG. 3) is analogous to Eq. 21, that is, recognizing that $I_1=I_4+I_5$, $$I_5/I_4=(R_4-R_1)/(R_1-R_5). \quad \text{(Eq. 23)}$$

While optimal stability is obtained by setting the relative currents according to this relationship, enhanced stability as compared to prior art systems still may be achieved when the quantities on each side of the equation differ by less than about 30%, or by less than about 10% or by less than about 1%.

Setting the relative currents may be done in many fashions, including but not limited to the following: (It is noted here we direct our teaching to the combination of elements 2 and 3 (as illustrated in, e.g., FIG. 3 elements 307 and 310), ordinarily skilled artisans will recognize that like considerations apply equally to the combination of elements 4 and 5, as illustrated in, e.g., FIG. 3 elements 313 and 316).

Figure 4:
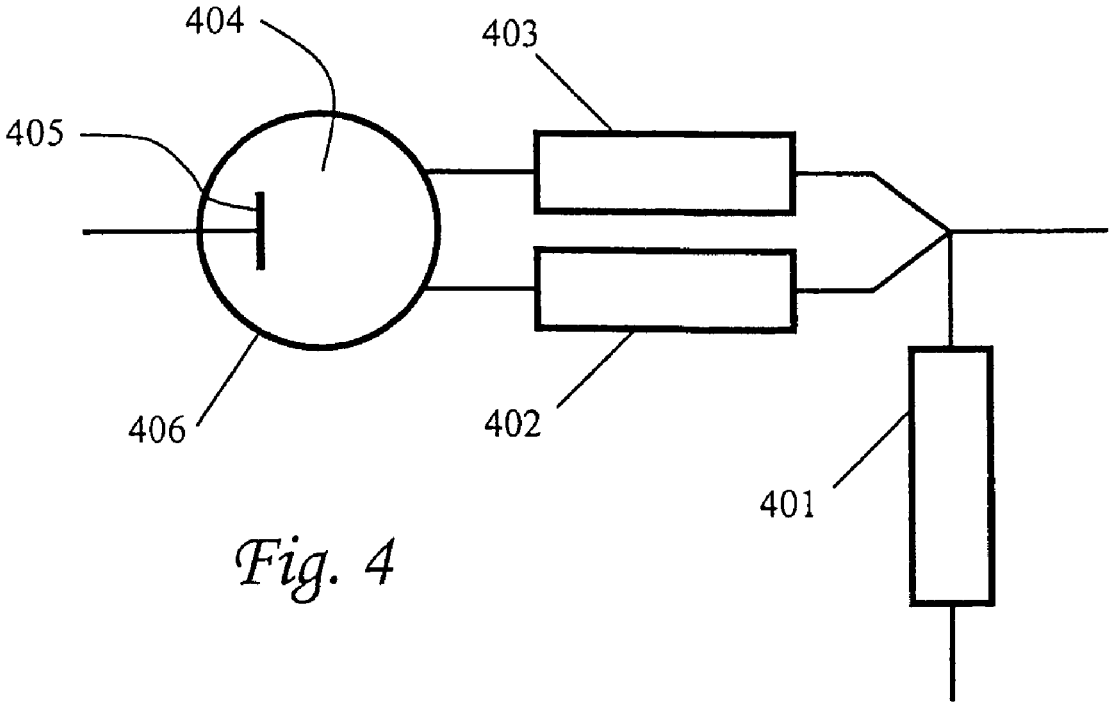
FIG. 4 is a schematic of a portion of an EOF system.

The case where elements 2 and 3 terminate in one common reservoir equipped with an electrode FIG. 4 illustrates a configuration in which one end of elements 2 and 3 (402 and 403) terminate in a common reservoir 406 equipped with an electrode 405 and filled with a fluid 404. The other end of elements 2 and 3 are connected to an EOF element 401 (element 1 in the nomenclature used throughout). Since elements 402 and 403 are in parallel the voltage drops across these elements are equal thus the relative currents are set by varying the effective resistances of the elements. One way to do this is according to the relative physical geometries of the elements, that is setting $$g_3/g_2=\alpha\sigma_2/\sigma_3, \quad \text{(Eq. 24)}$$

where g=A/LFn with A and L the physical cross sectional area and physical length of the element, respectively, and Fn is the formation factor of the material. The above equation may then be written:

$$A_3L_2/A_2L_3=\alpha\sigma_2F_3/\sigma_3F_2. \quad \text{(Eq. 25)}$$

The right-hand side of this equation is independent of physical geometry being a combination of factors that are each properties of fluid-saturated materials. Thus the matching condition is achieved by setting the relative areas and lengths of the two elements (402 and 403).

Figure 5:
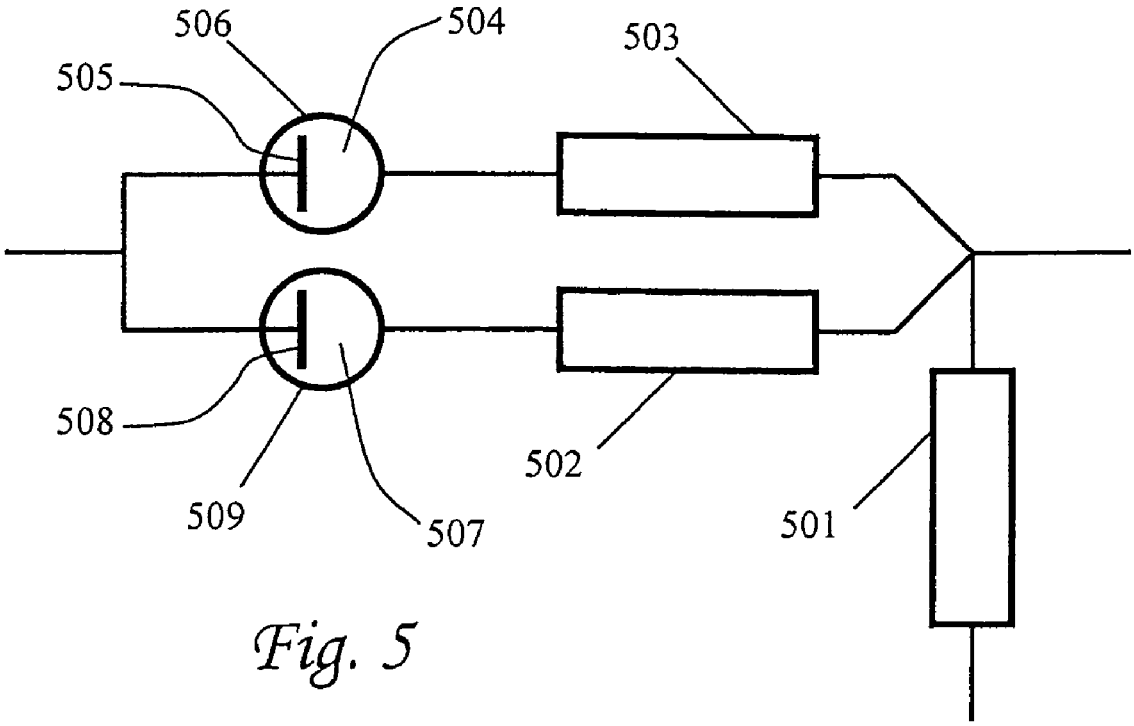
FIG. 5 is a schematic of a portion of an EOF system.

An equivalent configuration is illustrated in FIG. 5. Elements 2 and 3 (503 and 502) terminate on one end in separate reservoirs 506 and 509 equipped with electrodes 505 and 508 and filled with fluids 504 and 507. Electrodes 505 and 508 are electrically tied to a common potential. The other end of elements 2 and 3 are connected to EOF element 1 (501). As one of ordinary skill will recognize, given the equivalence of the configurations illustrated in FIG. 4 and FIG. 5, the matching condition is achieved by setting the relative areas and lengths of elements 2 and 3 (503 and 502). If the compositions of reservoir fluids 504 and 507 are non-equivalent, $\sigma_2$ may be non equal to $\sigma_3$. This will affect the final relative areas and lengths of elements 2 and 3 required to achieve the matching condition.

Figure 6:
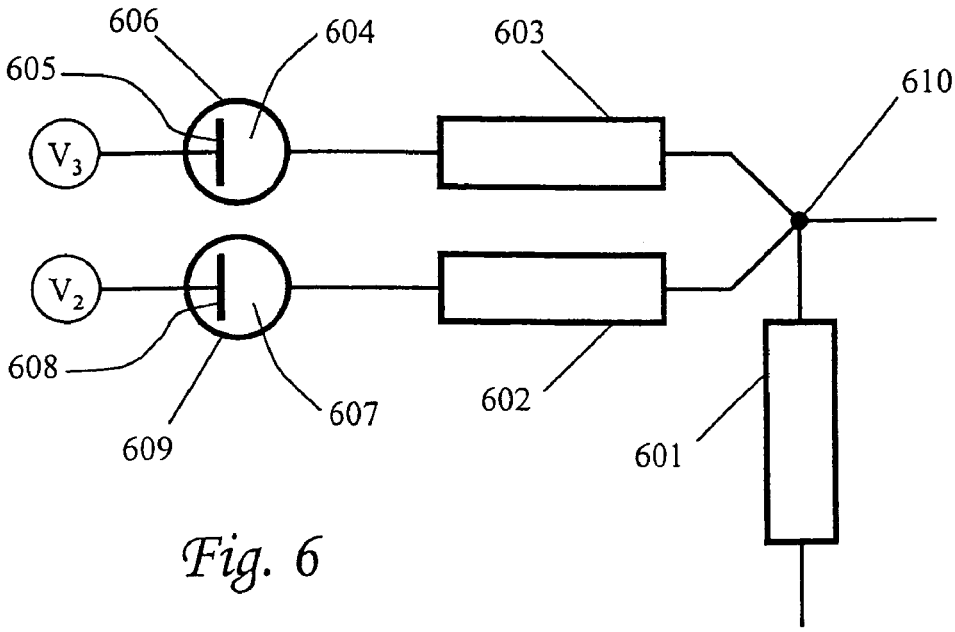
FIG. 6 is a schematic of a portion of an EOF system.

The case where the elements 2 and 3 terminate in separate reservoirs and the respective electrodes are not tied directly to a common potential FIG. 6 illustrates an alternate embodiment. Elements 2 and 3 (603 and 602) terminate on one end in separate reservoirs 606 and 609 equipped with electrodes 605 and 608 and filled with fluids 604 and 607. Electrodes 605 and 608 are not electrically tied to a common potential. The other end of elements 2 and 3 are connected to EOF element 1 (601). The potential at the common node of elements 2 and 3 (610) is taken as $V_{23}$. The matching condition is then achieved by setting the electrode 608 potential $V_2$ and electrode 605 potential $V_3$, to satisfy $$\sigma_2 g_2(V_{23}-V_2)=I_1/(1+\alpha) \quad \text{(Eq. 26)}$$

and $$\sigma_3 g_3(V_{23}-V_3)=I_1\alpha/(1+\alpha). \quad \text{(Eq. 27)}$$

Alternatively the respective currents through element 2 and 3 (602 and 603) could be measured and the potentials $V_2$ at electrode 608 and $V_3$ at electrode 605 adjusted accordingly.

Figure 7:
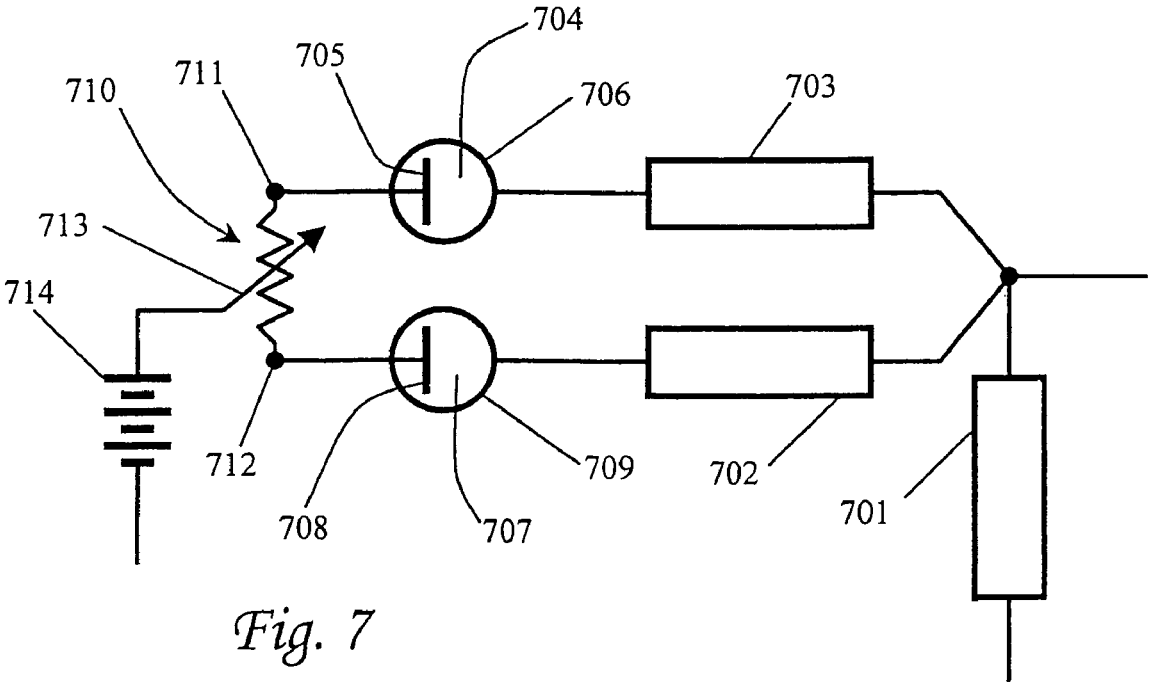
FIG. 7 is a schematic of a portion of an EOF system.

Alternatively the electrodes in the reservoirs attending elements 2 and 3 may be connected to a common potential via resistors 325 and 326 (as shown in FIG. 3). The matching condition is achieved by satisfying $$(r_2+1/\sigma_2 g_2)/(r_3+1/\sigma_3 g_3)=\alpha, \quad \text{(Eq. 28)}$$

where $r_2$ and $r_3$ are the values of the external resistors connected in electrical series with element 2 and 3, respectively. Thus the matching may be done by a combination of varying the relative geometries and/or the external resistance values and/or terminal reservoir composition and/or electrode potentials. Setting the relative currents may be aided by measuring the voltage drops across hence the currents through resistors 325 and 326 in FIG. 3. As illustrated in FIG. 7, a single variable or tapped resistor 710 may be employed where the ends 711, 712 are connected to electrodes 705, 708 in electrode reservoirs 706, 709, filled with fluid 704, 707. Electrodes 708, 705 supply voltage to bridge elements 702, 703, which elements are in communication with EOF element 1 (701). Wiper or tap 713 of variable or tapped resistor 710 is connected to the common power supply 714, and by this provides a direct means of adjusting or trimming the relative currents.

It is preferable to take a substantial fraction of the total potential (i.e., the total potential difference across the whole system) difference across the active EOF element. Thus it is preferable to select bridge geometry and any external resistors such that $$(r_b+1/\sigma_b g_b) \ll 1/\sigma_1 g_1, \quad \text{(Eq. 29)}$$

where the subscript 'b' refers to the bridge elements (e.g., 307, 310, 313, 316 of FIG. 3). The inequality in the equation above essentially states the preference to use most of the available potential across the active element, the system will function even if this inequality is not satisfied. A preferable case would be that the left hand side of this equation is less than 10% of the right hand side; a more preferable case would be less than 5% or less than 1%.

Figure 8:
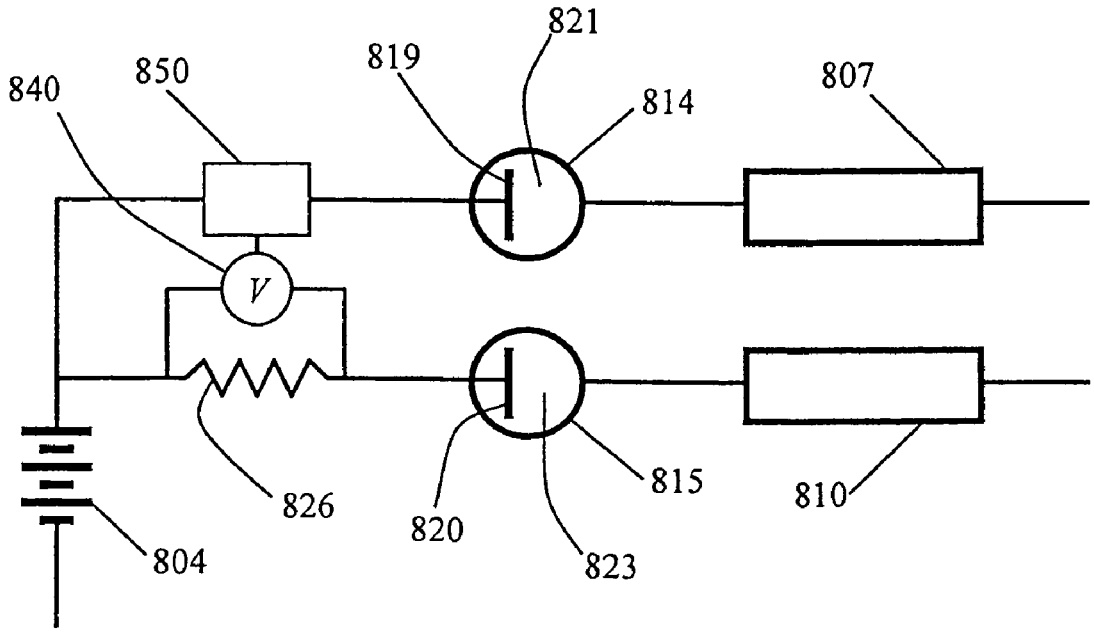
FIG. 8 is a schematic of a portion of an EOF system.

Many methods and combinations of sensing and controlling the currents through bridge elements 2 and 3 are well known in the electrical engineering art. One example is illustrated in FIG. 8, which depicts bridge elements 807, 810 connected to electrode reservoirs 814, 815 filled with fluids 821, 823, containing electrodes 819, 820. Current flowing in the circuit supplying 810 (element 3) is determined by using voltmeter 840 to measure the voltage drop across resistor 826. Signal from voltmeter 840 is used to control a current limiting device 850 between electrode 819 and the common supply potential 804 (e.g., a National Semiconductor LM 134 3-terminal adjustable current source). Such a sense and control servo loop may include a computer or mechanical components.

Embodiments Having More than Two Bridge Elements

It will be seen that a set of bridge elements (having flux ratios $R_2$, $R_3$, $R_4$, and so on) that are arranged electrically in parallel (carrying current $I_2$, $I_3$, $I_4$, and so on) present an effective flux ratio, $R_b$, for the set. For a set of three bridges, this effective flux ratio is given by:

$$R_b=(I_2R_2+I_3R_3+I_4R_4)/I_1, \quad \text{(Eq. 30)}$$

where $I_1$ is the total current. The extension to two or more than three bridges is apparent to one of ordinary skill.

Referring to FIG. 3: The flux ratios of bridge elements 307 and 310 are $R_2$ and $R_3$, respectively. The currents carried by bridge elements 307 and 310 are $I_2$ and $I_3$, respectively. The current carried by EOF element 301 is $I_1$ and the flux ratio of EOF element 301 is $R_1$. The flow of liquid 338 is taken from reservoir 337, through the common junction between bridge elements 307 and 310 and EOF element 301, then through EOF element 301. The concentration of the liquid entering EOF element 301 is taken to be C and the concentration of liquid 338 in reservoir 337 is taken to be $C_o$.

Following along the line of the discussion presented above with respect to the three cases for flow through the elements shown in FIG. 1 (described by Eqs. 7 and 8), under matched bridge conditions the concentration C will be equal to $C_o$. Whereas under mismatched conditions the concentration C will be greater or less than $C_o$ where the sign of the deviation will depend of the sign of the mismatch between the flux ratios.

It will be appreciated that the conductivity of the liquid flowing through EOF element 301 varies in proportion to the concentration C. Under the preferable condition that most of the total voltage drop occurs across EOF element 301, the total current varies in proportion to this conductivity and hence to the concentration C. Thus if C is reduced the total current will decrease whereas if C is increased the total current will increase. For slight deviation of C from $C_o$ the total current can achieve a new steady state whereas for substantial deviations the system is inherently unstable and the current will drift in time until the system fails or until any externally imposed current limit is reached.

For EOF element 301 constructed using a material having a negative zeta potential.

For $R_b>R_1$ concentration C will increase hence the total current will increase. This is corrected (i.e., the time variation in the total current is arrested) by increasing the fraction of current carried by the most positive zeta potential bridge in the set of bridges.

For $R_b<R_1$ concentration C will decrease hence the total current will decrease. This is corrected by increasing the fraction of current carried by the most negative zeta potential bridge in the set of bridges.

For EOF element 301 constructed using a material having a positive zeta potential.

For $R_b>R1$ concentration C will decrease hence the total current will decrease. This is corrected by increasing the fraction of current carried by the most positive zeta potential bridge in the set of bridges.

For $R_b<R1$ concentration C will increase hence the total current will increase. This is corrected by increasing the fraction of current carried by the most negative zeta potential bridge in the set of bridges.

Or more compactly: If the total current increases (i.e., C is increasing) the corrective action is to decrease the fraction of the total current flowing through the upstream bridge element having a zeta potential of the same sign as that of the EOF element. Whereas if the total current is decreases (i.e., C is decreasing) the corrective action is to increase the fraction of the total current flowing through the bridge element having a zeta potential of the same sign as that of the EOF element.

Thus observation of the time history of total current provides a means to sense the state of matching and to take corrective action. Observation of the time variation of the total current can be applied: 1) to facilitate initial set-up and trimming of the system; and 2) as the sense portion of a sense-and-control or feedback loop that continuously optimizes the matching. Methods, systems and tools for implementing and optimizing a sense-and-control loop are well known in the arts of electrical engineering.

Since the total current is modulated by the concentration C of the liquid upstream of the EOF element, the fractions of the total current flow in the elements of the bridge set connected to the upstream end of the EOF element are adjusted to meet the matching condition. Once the current fractions are determined for the set of bridges connected to the upstream end of the EOF element, these same fractions are applied to the set of bridges connected to the downstream end of the EOF element.

It will be appreciated that in using the invention, the sensitivity to minor variations in conductivity or zeta potential, resulting for inevitable variations in, e.g., composition or temperature, can be reduced by using R-values for the bridges that closely bracket the R-value of the EOF element. However, a significant advantage of the invention is found in using extreme bridge R-values making the invention generally applicable to a wide range of liquids. The difference between the liquid flux ratio, $R_f$ (see Eq. 5), and flux ratio of many EOF devices tends to lie in the range of about −0.2 to about 0.2. In general the magnitude of the liquid flux ratio is less than 0.25. The use of three or more bridges elements in parallel retains the general applicability of the invention and reduces the sensitivity to variations in system parameters.

We consider the case where three (or more) bridge elements are connected electrically in parallel. The first end of each bridge element is in liquid communication with a liquid-filled reservoir and each reservoir contains an electrode. The second ends of the three bridge elements are connected at a common junction with the first end of an EOF element. The current flowing through the EOF element, $I_1$, is equal to the sum of the currents, $I_2$, $I_3$ and $I_4$, flowing through the three bridge elements. The EOF element and the first, second and third bridge elements have flux ratios, $R_1$, $R_2$, $R_3$ and $R_4$, respectively. The condition for matching may then be written:

$$I_2R_2+I_3R_3+I_4R_4=I_1R_1, \quad \text{(Eq. 31)}$$

recognizing that $$I_1=I_2+I_3+I_4. \quad \text{(Eq. 32)}$$

The current flowing through the third bridge element is selected to be some fraction of the current $I_1$, that is $I_4=bI_1$ where the quantity b lies in the range $0 \leqq b \leqq 1$. The matching condition is satisfied by setting the fractional current flowing through the second bridge element:

$$I_2/I_1=((R_1-R_3)+b(R_3-R_4))/(R_2-R_3), \quad \text{(Eq. 33)}$$

and thus the fractional current through the third bridge element, $$I_3/I_1=((R_2-R_1)-b(R_2-R_4))/(R_2-R_3). \quad \text{(Eq. 34)}$$

It will be seen that these ratios of currents reduce to those given in Eqs. 19 and 20 in the limit that no current flows through the third bridge element (i.e., for b=0). The value of the flux ratio of the third bridge element, $R_4$, is selected to be in between the values $R_2$ and $R_3$ (for example with $R_2$ about +1 and $R_3$ about −1, $R_4$ is selected to be about 0). More preferably the flux ratio of the third bridge element is selected to be about equal to the liquid flux ratio. This preferable condition can be achieved by using a third bridge element material that displays little or no zeta potential. The faction of the total current flowing through the third bridge element is selected to be a substantial portion of the total current (i.e., $\frac{1}{3}<b<\frac{2}{3}$). In this fashion the third bridge element carries most of the current and the currents through the second and third bridge elements are adjusted to 'trim' the combined bridges flux ratio to match that of the EOF element.

As an example: Consider the case with $R_1=0.1$, $R_2=1$ and $R_3=-1$. Using a two bridge configuration requires setting $I_2/I_1=0.55$ and $I_3/I_1=0.45$. Using a three bridge arrangement with $R_4=0.2$ and b=0.6 requires setting $I_2/I_1=0.19$ and $I_3/I_1=0.21$.

An alternate mode of operation using three bridges in parallel is to selectively power the pair of bridges that bracket the flux ratio of the EOF element (e.g., following the example given immediately above, for $R_1=0.3$ the first and third bridges with $R_2=1$ and $R_4=0.2$, respectively would be used, whereas for $R_1=-0.2$ the second and third bridges would be used).

The analysis given above can be easily extended by those of skill in the art to the use of four or more bridges running in parallel.

Materials

Bridge materials useful for practicing embodiments of the invention having pluralities of bridge elements connected in parallel are selected so that cr2<cr1 and cr1<cr3. Any materials satisfying these requirements may be used and the considerations of optimizing geometry and terminal junctions are essentially the same as for a single bridge element, as set forth in U.S. patent application Ser. No. 10/137,215, incorporated herein by reference for all purposes.

The Use of Exchange Membranes and Highly Ion Selective Materials as Elements in Bridge Devices Ion exchange membranes are often employed to selectively remove polyvalent ions. To this end ion exchange membrane materials that employ a combination of negative and positive surface charge sites are commercially available. As a result such ion exchange membranes tend to have flux ratios near that of the liquid flux ratio when applied to liquids bearing singly valent ions. Such membranes offer very low permeability to liquid flow and can be used in the practice of the invention such as for, e.g., embodiments including a third bridge element described above or other equivalent embodiments that will be recognized by those of ordinary skill.

Highly ion selective materials are characterized by a very high degree of selectivity towards one sign of ion. Cation- and anion-selective materials transport current as nearly all positive or negative ions, respectively, hence have charge ratios approaching ±∞, respectively. As a result these materials are generally inapplicable in single-bridge applications. These materials are ideal materials for use in bridges of the present invention as any pair of cation/anion exchange elements brackets the charge ratio essentially any material used as an active EOF element.

Cation and anion exchange materials are well developed and commercially available in a wide variety of formats. Manufacturers include: Dupont, Pall RAI Inc., Stantech, Tokuyama Soda Co., Rhone-Poulence, Ionics Inc., Ionac Chemical Co., Ashai Glass Co., Ashai Chemical Co. The materials may be selected for a variety of properties that may enhance particular applications, such as: preferred selectivity to monovalent species, particular chemical or pH range stability, relatively low apparent diffusion. Ion exchange materials are generally designed for: 1) high permaselectivity (often exceeding 90%, permaselectivity being the fraction of total current carried by one sign of ion); 2) low permeability to pressure and/or electroosmotic flow (in many cases the pressure-driven flow rates through these materials converts to the material having nanometer scale pores); 3) relatively high electrical conductivity. All of these properties are preferable in bridge applications of the present invention. In these limits (i.e., the bridge material pore size is very small compared to the active element pore size, and the bridge material does not support electroosmotic flow), equation 15 of U.S. patent application Ser. No. 10/137,215 becomes:

$$Q=Q_{pf}/(1+2g_1\sigma_1(r_{2x}+1/g_2\sigma_2)/(1+\alpha)). \quad \text{(Eq. 35)}$$

The second term in the denominator can be made arbitrarily small, hence the flow rate achieved in the active element is near-ideal, by selecting a value $r_{2x}$ about equal to the apparent resistance of the bridge elements and by selecting a bridge geometry factor substantially larger than that of the active element. Thus the use of ion exchange media provides a performance enhancement in flow realized and a significant degree of flexibility in geometric design of the bridge elements.

For near-unit permaselectivity of the bridge materials, the respective flux ratios will be about $R_2=1$ and $R_3=-1$. Thus the equation of paragraph 0 reduces to:

$$I_3/I_2 \equiv \alpha = (1-R_1)/(R_1+1). \quad \text{(Eq. 36)}$$

As noted above, the combination of almost any active element and almost any fluid will have a flux ratio between ±1. Whereas in either extreme limit (i.e., $R_1$ tends to ±1) the proper choice is a single bridge element using an ion-exchange material matching the sign of the active element flux ratio.

Bridge Reservoir Fluids

Owing to the low flow permeability and low apparent diffusion coefficients through conventional ion-exchange materials, it is possible to use concentrated solutions in the reservoirs attending the bridge elements without compromising the integrity of the process liquid. Obviously, the composition of the liquids in these reservoirs evolves in time as charge is transferred at the liquid/electrode interface and as ions are transferred through the bridge elements. The use of concentrated solutions in these reservoirs, including, optionally, buffering species, makes it possible to operate for longer periods of time and/or to employ a smaller volume reservoir.

To illustrate the issue consider a simple system of electrode-equipped anode and cathode reservoirs connected via bridges to a fine liquid-filled open conduit. The working fluid is taken to be 10 mM NaCl in aqueous solution at pH 7 and the reservoirs to be filled with 1 mL of the same liquid. At a current of 10 microamperes, in about 3 hours the cathode and anode reservoirs will evolve to conditions (i.e., about pH 11 and pH 3, respectively) where OH and H ions represent more than 10% of the charge transfer through the bridges and thus the working fluid is noticeably modified. If instead the bridge reservoirs were initially filled with 100 mM NaCl, the same condition would be reached in about 30 hours. Using a bridge between the reservoir and the conduit makes it possible to employ a concentrated solution in the reservoir. However the bridge must be essentially impermeable to flow and also provide relatively low apparent ion diffusion.

Consider, for example, the system 300 illustrated in FIG. 3: Working fluid 338 in reservoir 337 is taken to be 10 mM NaCl in aqueous solution at pH 7 and the zeta potential of active EOF element 301 is taken negative yielding a finite positive value of the flux ratio different from that of the bulk fluid. The overall potential gradient is set to provide flow through active EOF element as shown in FIG. 3 (i.e., positive potential difference Vo−V). The bridge elements 2 and 4 (i.e., 307, 313) are in this particular example taken as cation exchange materials and bridge elements 3 and 5 (i.e., 310, 316) as anion exchange materials. The current ratios $I_3/I_2$ and $I_5/I_4$ are set according to the equations set forth in Eqs. 21 and 23 above. The simplest case would be to fill all four bridge reservoirs (321, 323, 329, and 331) with the working fluid, however the stable running time would be limited (as noted in the illustration immediately above) according to the reservoir volumes and the current.

One means to extend the operating time would be to fill all four bridge reservoirs (321, 323, 329, and 331) with a concentrated NaCl solution (as noted above a 10-fold increase over the concentration in the working fluid would provide a 10-fold increase in stable run time). Alternatively, reservoirs 323 and 329 may be filled with low concentration fluid but preferably a concentration no lower than about that in the working fluid, and reservoirs 321 and 331 filled with high concentration fluid. Using unequal starting concentration provides the benefit that the reservoirs all tend to about the same ionic strength over the course of operation.

Alternatively, reservoir 321 may contain a solution comprising a relatively higher concentration of NaOH, reservoir 329 may contain a solution comprising a relatively lower concentration of HCl, reservoir 329 may contain a solution comprising a relatively lower concentration of NaOH, and reservoir 331 may contain a solution comprising a relatively higher concentration of HCl. As used in the foregoing, in one embodiment, a relatively higher concentration is a concentration on the order of about 10 to 100 times the ionic strength of the liquid flowing in the EOF element 301, and a relatively lower concentration is a concentration that is on the order of about 10 time less to about equal to the ionic strength of the liquid flowing in the EOF element 301. In this scheme the pH evolution of all four reservoirs is moderated, and with time the ionic strength of reservoirs 321 and 331 decreases and that of reservoirs 323 and 329 increases. Obviously, using various combinations of strong acids/bases and their associated salt at various concentrations may be advantageously employed by ordinarily skilled practitioners to moderate both pH and ionic strength evolution.

A further method that does not require the use of higher concentration of strong acids or bases is to employ buffering species. For example: the fluid in all four bridge reservoirs comprise a relatively higher concentration (here 'a relatively higher concentration' is a concentration on the order of about 10 to 100 times the ionic strength of the liquid flowing in the EOF element 301), e.g., reservoir 321 comprises Na-MES at the basic end of the MES buffering range, reservoir 323 comprises BIS-TRIS-Cl at the basic end of the BIS-TRIS buffering range, reservoir 329 comprises BIS-TRIS-Cl at the acidic end of BIS-TRIS buffering range and reservoir 331 comprises Na-MES at the acidic end of the MES buffering range. The buffers (in this example, BIS-TRIS and MES) moderate the pH evolution, and the use of high versus low concentrations provides that over the course of operation the concentrations in the reservoirs tend to an intermediate value.

A further method is to employ reversible electrodes (e.g., Ag:AgCl) in the bridge reservoirs. Stable operation of a reversible electrode preferably requires a high concentration of supporting electrolyte. For example, the Ag:AgCl electrode operation is more stable and can support a proportionally higher current flux in 100 mM NaCl than in 10 mM NaCl). The use of impermeable bridge elements makes it possible to use such electrodes for a wide variety of working fluids. In practicing such embodiments, an ordinarily skilled artisan will recognize that one of the ionic carriers in the working fluid should be one of the ionic reactants in the electrode cycle.

In general, stable operation is provided through the use of optimal bridges as long as the primary charge carriers through the bridges are the same primary charge carriers in the active element. Electrochemical evolution of the fluid in the bridge-attendant reservoirs is inevitable. Thus for a finite volume reservoir stable operation is possible up to the point that the fluids in these reservoirs do not source/sink the necessary primary charge carriers. The bridge devices of the present invention make it possible to employ essentially flow-impermeable materials and thus makes it possible to use concentrated fluid additives and/or special electrodes in the bridge-attendant reservoirs that can provide extended operating time. To this end, any of the methods well known in the electrochemical arts (e.g., reversible electrodes, buffers, capacitive electrodes, pseudo-capacitive electrodes) for stabilizing a fluid against pH and ionic strength variations may be incorporated.

The comments here have been directed at the aqueous NaCl system and to one sign of zeta potential. The extension of these devices and methods to other fluids, additives and zeta potentials are analogous and will be evident to those skilled in the electrochemical arts.

The foregoing description of the embodiments of the invention has been presented for the purposes of illustration and description. It is not intended to be exhaustive or to limit the invention to the precise forms disclosed. Persons skilled in the relevant art can appreciate that many modifications and variations are possible in light of the above teaching. It is therefore intended that the scope of the invention be limited not by this detailed description, but rather by the claims appended hereto.

All references, issued patents and patent applications cited within the body of the instant specification are hereby incorporated by reference in their entirety, for all purposes.

We claim:

1. An electroosmotic flow system comprising:

a. an electroosmotic flow element having:
  i. a charge ratio cr1;
  ii. a first end; and,
  iii. a second end;

b. a power supply having:
  i. a first terminal in electrical communication with the first end of the electroosmotic flow element; and,
  ii. a second terminal in electrical communication with the second end of the electroosmotic flow element;

c. a first bridge element having:
  i. a charge ratio cr2;
  ii. a first end; and,
  iii. a second end,
    wherein the first end of the first bridge element is in fluidic and electrical communication with the first end of the electroosmotic flow element, and,
    wherein the second end of the first bridge element in electrical communication with the first terminal of the power supply;

d. a second bridge element having:
  i. a charge ratio cr3;
  ii. a first end; and,
  iii. a second end,
    wherein the first end of the second bridge element is in fluidic and electrical communication with the first end of the electroosmotic flow element;
    wherein the second end of the second bridge element is in electrical communication with the first terminal of the power supply;
    wherein the first bride element and second bridge element are electrically connected in parallel; and,
    wherein cr2<cr1, and cr1<cr3;

e. a first electrode electrically connected to the first terminal of the power supply;

f. a second electrode electrically connected to the first terminal of the power supply;

g. a first electrode reservoir containing:
  i. the first electrode; and,
  ii. a first fluid;
    wherein the first electrode is in electrical communication with the first fluid; and,
    wherein the second end of the first bridge element is in fluidic communication with the first fluid; and, h. a second electrode reservoir containing:
  i. the second electrode; and,
  ii. a second fluid,
    wherein the second electrode is in electrical communication with the second fluid; and,
    wherein the second end of the second bridge element is in fluidic communication with the second fluid;
    wherein the composition of said first fluid differs from the composition of said second fluid.

2. An electroosmotic flow system comprising:

a. an electroosmotic flow element having:
  i. a charge ratio cr1;
  ii. a first end; and,
  iii. a second end;

b. a power supply having:
  i. a first terminal in electrical communication with the first end of the electroosmotic flow element; and,
  ii. a second terminal in electrical communication with the second end of the electroosmotic flow element;

c. a first bridge element having:
  i. a charge ratio cr2;
  ii. a first end; and,
  iii. a second end;
    wherein the first end of the first bridge element is in fluidic and electrical communication with the first end of the electroosmotic flow element; and,
    wherein the second end of the first bridge element in electrical communication with the first terminal of the power supply;

d. a second bridge element having
  i. a charge ratio cr3;
  ii. a first end; and,
  iii. a second end;
    wherein the first end of the second bridge element is in fluidic and,
    electrical communication with the first end of the electroosmotic flow element and the second end of the second bridge element is in electrical communication with the first terminal of the power supply; and,
    wherein the first bride element and second bridge element are electrically connected in parallel and wherein cr2<cr1, and cr1<cr3;

e. a third bridge element having:
  i. a charge ratio cr4;
  ii. a first end; and,
  iii. a second end;
    wherein the first end of the third bridge element is in fluidic and electrical communication with the second end of the electroosmotic flow element; and,
    wherein the second end of the third bridge element is in electrical communication with the second terminal of the power supply;

f. a fourth bridge element having:
  i. a charge ratio cr5;
  ii. a first end; and,
  iii. a second end;
    wherein the first end of the fourth bridge element is in fluidic and electrical communication with the second end of the electroosmotic flow element;

wherein the second end of the fourth bridge element is in electrical communication with the second terminal of the power supply; and, wherein the third bridge element and the fourth bridge element are electrically connected in parallel and wherein cr4<cr1, and cr1<cr5;

g. a first electrode electrically connected to the first terminal of the power supply;

h. a second electrode electrically connected to the second terminal of the power supply;

i. a first electrode reservoir containing:

i. the first electrode; and, ii. a first fluid:

wherein the first electrode is in electrical communication with the first fluid; and, wherein the second end of the first bridge element is in fluidic communication with the first fluid; and, j. a second electrode reservoir containing:

i. the second electrode; and, ii. a second fluid;

wherein the second electrode is in electrical communication with the second fluid;

wherein the second end of the second bridge element is in fluidic communication with the second fluid; and, wherein the composition of said first fluid differs from the composition of said second fluid.

3. An electroosmotic flow system comprising:

a. an electroosmotic flow element having:

i. a charge ratio cr1;

ii. a first end; and, iii. a second end;

b. a power supply having:

i. a first terminal in electrical communication with the first end of the electroosmotic flow element; and, ii. a second terminal in electrical communication with the second end of the electroosmotic flow element;

c. a first bridge element having:

i. a charge ratio cr2;

ii. a first end; and, iii. a second end;

wherein the first end of the first bridge element is in fluidic and electrical communication with the first end of the electroosmotic flow element; and, wherein the second end of the first bridge element in electrical communication with the first terminal of the power supply;

d. a second bridge element having:

i. a charge ratio cr3;

ii. a first end; and, iii. a second end;

wherein the first end of the second bridge element is in fluidic and electrical communication with the first end of the electroosmotic flow element;

wherein the second end of the second bridge element is in electrical communication with the first terminal of the power supply; and, wherein the first bride element and second bridge element are electrically connected in parallel and wherein cr2<cr1, and cr1<cr3;

e. a third bridge element having:

i. a charge ratio cr4;

ii. a first end; and, iii. a second end;

wherein the first end of the third bridge element is in fluidic and electrical communication with the second end of the electroosmotic flow element; and, wherein the second end of the third bridge element is in electrical communication with the second terminal of the power supply;

f. a fourth bridge element having:

i. a charge ratio cr5;

ii. a first end; and, iii. a second end;

wherein the first end of the fourth bridge element is in fluidic and electrical communication with the second end of the electroosmotic flow element;

wherein the second end of the fourth bridge element is in electrical communication with the second terminal of the power supply; and, wherein the third bridge element and the fourth bridge element are electrically connected in parallel and wherein cr4<cr1, and cr1<cr5;

g. a first electrode electrically connected to the first terminal of the power supply;

h. a second electrode electrically connected to the second terminal of the power supply;

i. a first electrode reservoir containing:

i. the first electrode; and, ii. a first fluid:

wherein the first electrode is in electrical communication with the first fluid; and, wherein the second end of the first bridge element is in fluidic communication with the first fluid; and, j. a second electrode reservoir containing:

i. the second electrode; and, ii. a second fluid;

wherein the second electrode is in electrical communication with the second fluid;

wherein the second end of the second bridge element is in fluidic communication with the second fluid; and, k. a third electrode electrically connected to the second terminal of the power supply;

l. a fourth electrode electrically connected to the second terminal of the power supply;

m. a third electrode reservoir containing the third electrode and a third fluid;

wherein the third electrode is in electrical communication with the third fluid; and, wherein the second end of the third bridge element is in fluidic communication with the third fluid; and, n. a fourth electrode reservoir containing:

i. the fourth electrode; and, ii. a fourth fluid;

wherein the fourth electrode is in electrical communication with the fourth fluid; and, wherein the second end of the fourth bridge element is in fluid communication with the fourth fluid.

4. A bridge system for connecting one end of an electroosmotic flow element to a power supply, the bridge system comprising:

a. a plurality of bridge elements, including a first bridge element and a second bridge element, electrically connected in parallel to each other and electrically connected to said electroosmotic flow element;

b. a reservoir of bridge fluid in liquid communication with a first end of said first bridge element; and, c. a reservoir of working fluid in liquid communication with said electroosmotic flow element;

wherein the composition of said bridge fluid differs from the composition of said working fluid.

* * * * *